US005315213A

United States Patent [19]

Kim

[11] Patent Number: 5,315,213

[45] Date of Patent: May 24, 1994

[54] STRUCTURE AND DRIVING METHOD OF A PLASMA DISPLAY PANEL

[75] Inventor: Dae-il Kim, Suwon, Rep. of Korea

[73] Assignee: Samsung Electron Devices Co., Ltd., Kyungki, Rep. of Korea

[21] Appl. No.: 970,832

[22] Filed: Nov. 3, 1992

[30] Foreign Application Priority Data

Nov. 4, 1991 [KR] Rep. of Korea ..... 91-19532

[51] Int. Cl.[5] ..... G09G 3/10

[52] U.S. Cl. ..... 315/169.1; 315/169.3; 315/169.4; 315/167; 313/584; 313/585; 313/586; 313/587

[58] Field of Search ..... 315/169.1, 169.3, 169.4, 315/58, 71, 167; 313/584, 585, 586, 587

[56] References Cited

U.S. PATENT DOCUMENTS

| | | | |
|---|---|---|---|
| 4,996,460 | 2/1991 | Kim et al. | 313/587 |
| 4,999,541 | 3/1991 | Kim et al. | 313/585 |
| 5,150,011 | 9/1992 | Fujieda | 313/584 |
| 5,175,473 | 12/1992 | Kim | 313/585 |

*Primary Examiner*—James B. Mullins
*Assistant Examiner*—J. Dudek
*Attorney, Agent, or Firm*—Leydig, Voit & Mayer

[57] ABSTRACT

A plasma display panel includes barriers arranged in a striped form on a front plate, a sustaining electrode formed over the entire surface of a backing plate, insulating layers coated on the sustaining electrode in a matrix form, first electrodes formed on the first insulating layers in a striped form, second insulating layers coated on the first electrodes in a striped form, and second electrodes formed on the second insulating layers. In the driving method, a pulse train having a predetermined period, generated so as to have an amplitude equivalent to a second voltage subtracted from a first voltage and riding on the second voltage, is applied to the sustaining electrode; one pulse generated so as to have an amplitude equivalent to a fourth voltage subtracted from a third voltage, is applied to the first electrodes when the pulse train equals the second voltage and rides on the fourth voltage; sequential pulses generated so as to have an amplitude equivalent to a sixth voltage subtracted from a fifth voltage, is applied to the second electrodes also when the pulse train equals the second voltage; a voltage for creating discharge is equivalent to the sixth voltage subtracted from the third voltage and greater than a discharge firing voltage; and a voltage for maintaining discharge once created while suppressing the discharge if not created, is equivalent to the fifth voltage subtracted from the first voltage and greater than a minimum discharge sustaining voltage but smaller than the discharge firing voltage.

18 Claims, 3 Drawing Sheets

STRUCTURE AND DRIVING METHOD OF A PLASMA DISPLAY PANEL

BACKGROUND OF THE INVENTION

The present invention relates to a structure and driving method of a plasma display panel, and more particularly to the structure and driving method of a plasma display panel having three electrodes.

Generally speaking, a plasma display panel (PDP) is a matrix-type display device and adopts a line-sequence driving method which lengthens the light-emission time, to double the number of signal lines of a dot-sequence driving method. An extended light-emission time enhances luminance. However, for DC color PDPs, the device itself is inefficient when compared with that used for a monochrome PDP. Therefore, luminance suffers when adopting the line-sequence driving method to a DC color plasma display panel, which is typically used only for monochrome plasma display panels.

To overcome the luminance deficiency, PDP driving methods have been proposed which protract the light-emission time for one field. One example of such a method is a so-called memory type driving method, wherein, if a cell is turned on once, it stays on for one field or one sub-field. In other words, while a plasma display panel using the line-sequence scanning method performs writing and erasing operations during every horizontal scanning period, in the memory type PDP, cells turned on for one horizontal scanning period stay illuminated for the duration of the next horizontal scanning period. Here, if the memory-type plasma display panel is operated using space charge, the panel is classified as a DC panel, and if the panel uses wall charge, it is classified as an AC panel.

FIG. 1 is a conventional plasma display panel showing the structure of a DC pulse, memory-type plasma display panel disclosed by NHK of Japan.

Referring to FIG. 1, the plasma display panel has a front plate 1 and a backing plate 2. Two writing anodes 3 and one auxiliary anode 4 are alternately and horizontally (or vertically) arranged in striped form on front plate 1. Backing plate 2 has a plurality of cathodes 5 vertically (or horizontally) arranged in striped form and a plurality of barriers 6 which surround both a writing discharge area 7 for discharge with writing anode 3 and an auxiliary discharge area 8 for discharge with auxiliary anode 4.

FIG. 2 shows waveforms applied to the respective electrodes of the plasma display panel in FIG. 1.

Referring to FIG. 2, when cathodes $K_1$, $K_2$, $K_3$ are sequentially scanned, an auxiliary discharge cell is discharged to continuously supply charge particles to a main discharge area. Here, if a main discharge should be created, a writing pulse is loaded before a sustaining pulse so that a cell of cathode $K_1$ generate discharge. Then, the sustaining pulse is continuously applied to maintain the discharge. The sustaining and scanning pulses should not coincide with each other, so that cells in which a writing-discharge is created stay on, while those in which a writing-discharge is not created stay off. That is, the auxiliary anode supplies charge particles, while the main anode is used for the writing and sustaining of discharge and the cathode is used for erasing the discharge.

However, the structure and driving method of the above plasma display panel has the following disadvantages:

First, writing discharge cells and auxiliary discharge cells (not used for writing) are disposed on the same plane. This is unfavorable for high resolution displays.

Secondly, since sustaining as well as writing discharges are performed by the main anode, its line resistance comes into question. In memory type panels, if the line resistance is great, all the cathodes under the main anode may be turned on, resulting in high current flow through the main anode and thus a large voltage drop. This would reduce operating margin. In practice, indium-tin-oxide (ITO) and Ni each have line resistances high enough to cause the above problem. The use of Au or Ag reduces line resistance, but since mercury adhering to the cathodes' surface is used in such cases to suppress damage thereto due to ion bombardment in DC memory-type PDPs, electrical opens may develop.

Thirdly, when a plurality of cells under one anode are turned on, the output impedance of a driving circuit should be low, such that the necessary driving waveforms are complicated.

SUMMARY OF THE INVENTION

Therefore, it is an object of the present invention to provide a structure of a plasma display panel suitable for high resolution displays by separating sustaining and scanning operations.

It is another object of the present invention to provide a simplified driving method for a plasma display panel.

In order to accomplish the first object, there is provided a plasma display panel comprising: front and backing plates; a plurality of barriers spaced with one another and arranged in a striped form on the front plate; a sustaining electrode formed over the entire surface of the backing plate; a plurality of first insulating layers coated on said sustaining electrode in a matrix form; a plurality of first electrodes formed on the first insulating layers in a striped form, parallel with the plurality of barriers and being in contact with the first insulating layers; a plurality of second insulating layers spaced apart by a certain interval and coated on the first electrodes in a striped form, perpendicular to the plurality of barriers; and a plurality of second electrodes formed on the second insulating layers so as to be in contact therewith.

According to another embodiment of the present invention, there is provided a plasma display panel comprising front and backing plates; a sustaining electrode formed over the entire surface of the backing plate; a plurality of barriers spaced with one another and arranged in a striped form on the sustaining electrode; a plurality of first electrodes formed on the backing plate in a striped form and arranged alternately and in parallel with the barriers; a plurality of second electrodes arranged in a striped form, perpendicular to the plurality of first electrodes; and a plurality of insulating layers formed between the overlapping portions of the plurality of first electrodes and the plurality of second electrodes.

In order to accomplish the second object, there is provided a method for driving a plasma display panel wherein: a pulse train having a predetermined period, generated so as to have an amplitude equivalent to a second voltage subtracted from a first voltage and riding on the second voltage, is applied to the sustaining electrode; one pulse generated so as to have an amplitude equivalent to a fourth voltage subtracted from a third voltage, is applied to the first electrodes when the pulse train equals the second voltage and rides on the fourth voltage; sequential pulses generated so as to have an amplitude equivalent to a sixth voltage subtracted from a fifth voltage, is applied to the second electrodes also when the pulse train equals the second voltage; a voltage for creating discharge is equivalent to the sixth voltage subtracted from the third voltage and greater than a discharge firing voltage; and a voltage for maintaining discharge once created while suppressing the discharge if not created, is equivalent to the fifth voltage subtracted from the first voltage and greater than a minimum discharge sustaining voltage but smaller than the discharge firing voltage.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
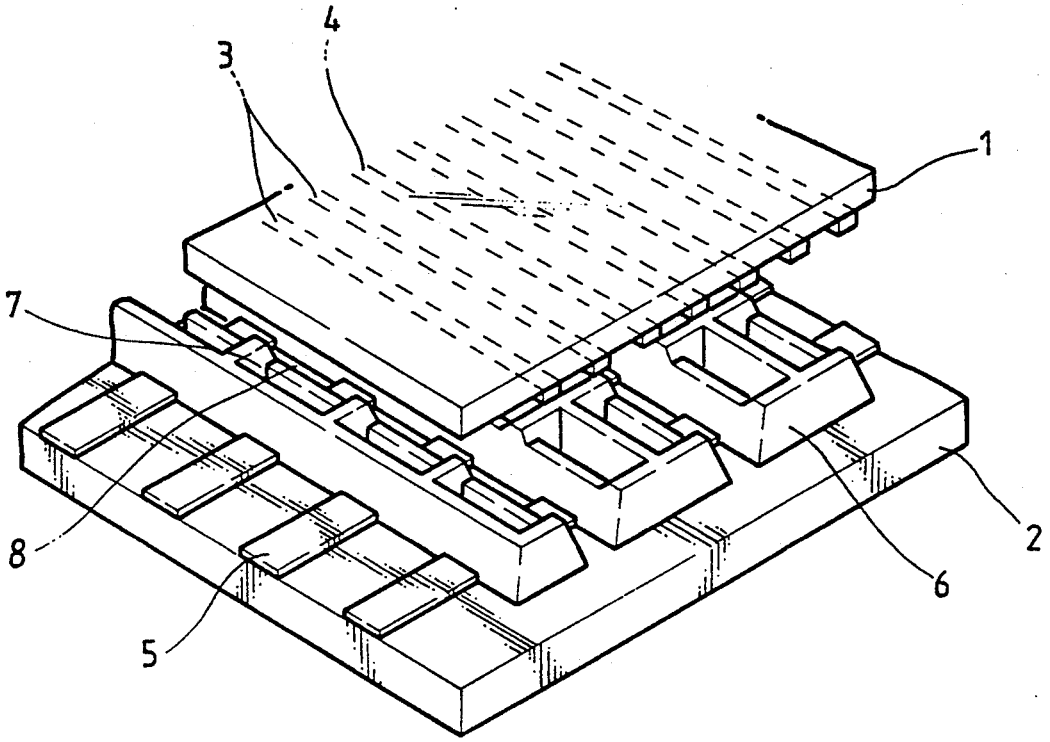
FIG. 1 (PRIOR ART)
FIG. 1 illustrates a conventional plasma display panel.
Figure 2:
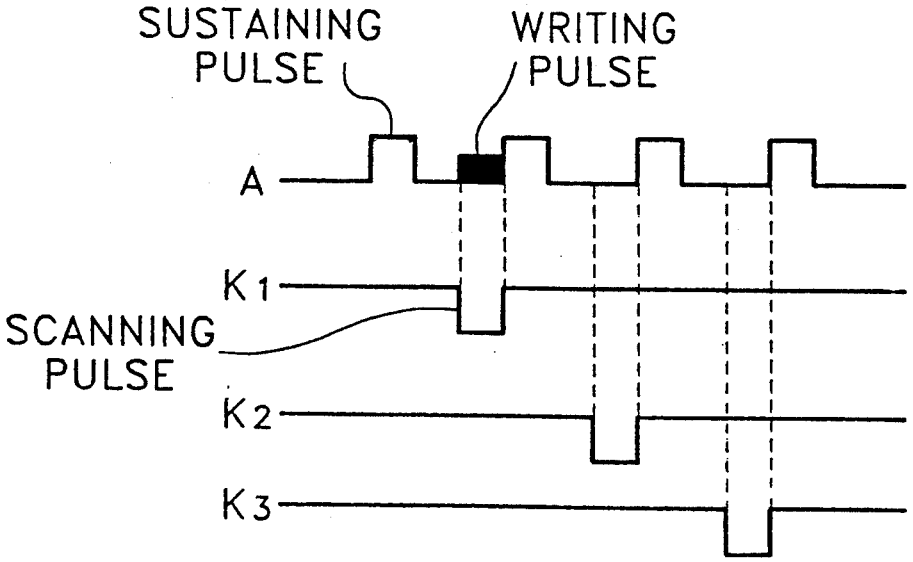
FIG. 2 (PRIOR ART)
FIG. 2 illustrates pulses applied to the respective electrodes of the conventional plasma display panel.
Figure 3:
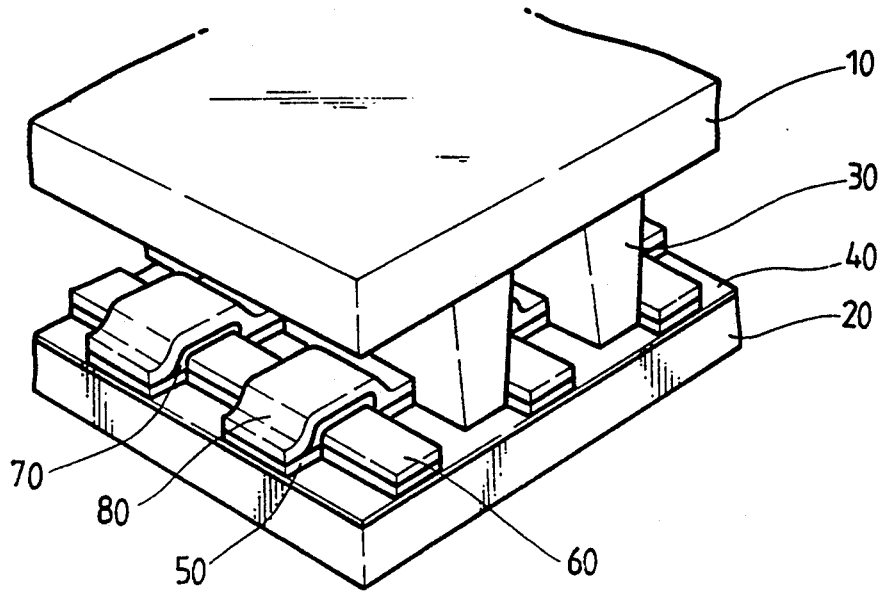
FIG. 3 illustrates an embodiment of the plasma display panel of the present invention.

Referring to FIG. 3, a plasma display panel has a front plate 10 and a backing plate 20. A plurality of barriers 30 are horizontally (or vertically) arranged on front plate 10 in a striped form. Backing plate 20 comprises a discharge sustaining electrode 40 formed over the entire surface thereof, a plurality of first insulating layers 50 coated on discharge sustaining electrode 40 in a matrix form, anodes 6 horizontally formed on the plurality of first insulating layers 50 in a striped form, a plurality of second insulating layers 70 coated on anodes 60, and cathodes 80 vertically (or horizontally) formed on second insulating layers 70 in a striped form.

In the configuration, since cathodes 80, anodes 60 and discharge sustaining electrodes 40, all of which are formed on backing plate 10, are not in a position to block discharge light transmitted to the front plate, the selection of their material is not limited beyond that which can be used for the formation of any electrode. In other words, they may be respectively formed of a material such as Ni which is easy to handle and has a low resistance rate.

Figure 4:
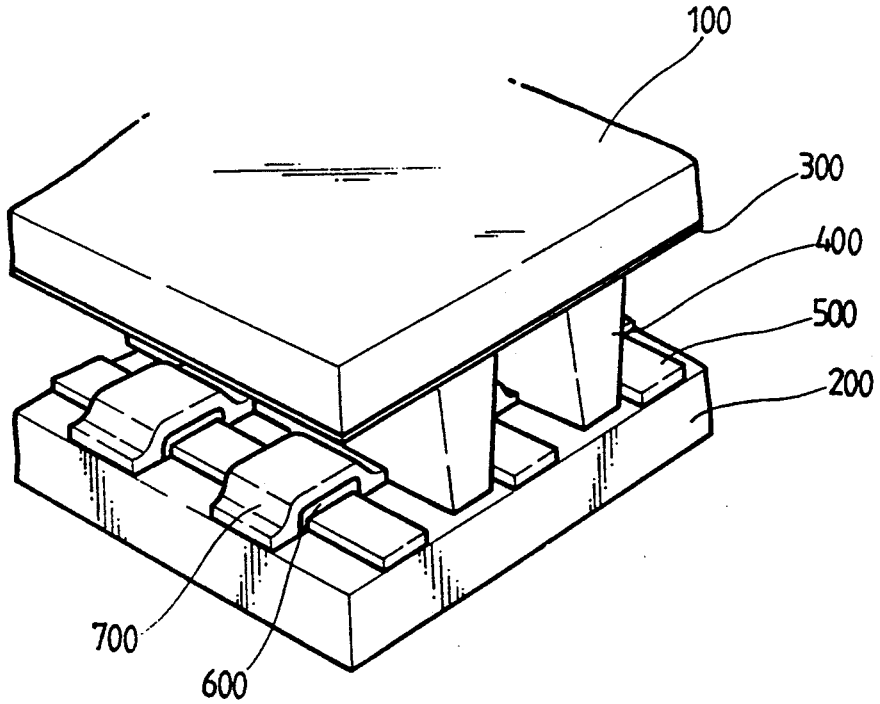
FIG. 4 illustrates another embodiment of the plasma display panel of the present invention.

Referring to FIG. 4, a plasma display panel has a front plate 100 and a backing plate 200. A discharge sustaining electrode 300 is formed over the entire surface of front plate 100. A plurality of barriers 400 are horizontally (or vertically) formed on discharge sustaining electrode 300 in a striped form. A plurality of anodes 500 are horizontally (or vertically) arranged on backing plate 200 in a striped form. An insulating layer 600 is coated on anodes 500. A plurality of cathodes 700 are vertically (or horizontally) formed on insulating layer 600. In this structure, each scanning electrode is separated from the respective sustaining electrodes. Here, since discharge sustaining electrode 300 is formed on front plate 100, a transparent conductive material such as ITO may be used.

Figure 5:
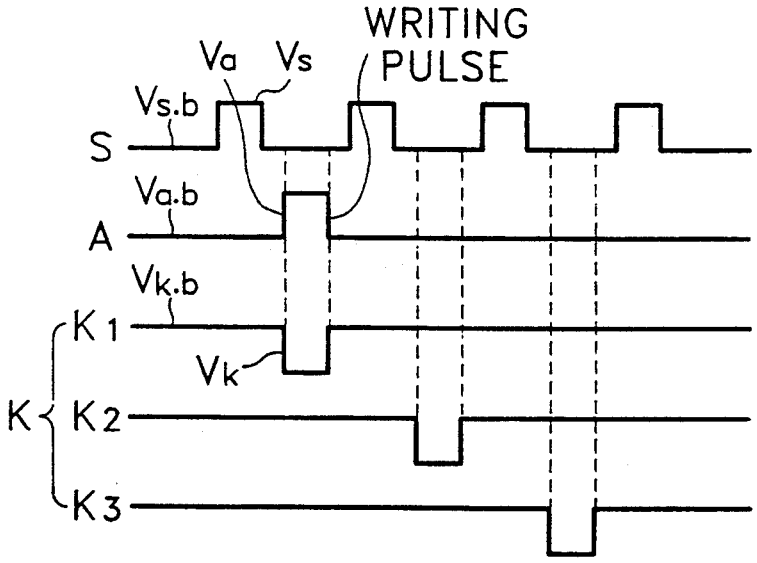
FIG. 5 illustrates pulses applied to the respective electrodes of the plasma display panel of the present invention.

Referring to FIG. 5, a pulse train S whose amplitude has the value in which a discharge sustaining bias voltage Vs.b is subtracted from a discharge sustaining voltage Vs, is input to the sustaining electrode. One pulse (A) whose amplitude has the value in which an anode bias voltage Va.b is subtracted from an anode voltage Va, is input during writing, at a time within the interval when only the discharge sustaining voltage Vs.b appears in the waveform applied to the sustaining electrode. A pulse $K_1$ whose amplitude has the value in which cathode voltage Vk is subtracted from a cathode bias voltage Vk.b, is input to the cathode, at a time which coincides with the pulse applied to the anode. Like pulses $K_2$, $K_3$ are sequentially applied to the cathodes during similar intervals, i.e., whenever only the discharge sustaining voltage Vs.b appears in the sustaining electrode.

According to the above operation, pulses are applied to the cathode at 4–8 μs intervals (determined by gray scale). Here, if a writing pulse is applied to the anode, the cell corresponding thereto is discharged. Then, even when the cathode is scanned "off," since a voltage equivalent to cathode bias voltage Vk.b subtracted from discharge sustaining voltage Vs, is applied to the cell via the sustaining electrode, the discharge is continued until an erasing pulse is applied to the cathodes (K). By doing this, a memory operation is accomplished. In order to create discharge, a writing discharge voltage is set to a value equivalent to cathode voltage Vk subtracted from anode voltage Va and greater than the discharge firing voltage. In order to maintain the discharge of a once-discharged cell and suppress the discharge of an undischarged cell, the discharge sustaining voltage is set to a value equivalent to cathode voltage Vk subtracted from discharge sustaining voltage Vs and greater than a minimum discharge sustaining voltage but smaller than the discharge firing voltage.

The driving method for the above-described plasma display panel is disclosed in U.S. patent application Ser. No. 07/832,902. The present invention pertains to the detailed structure and driving method of the same PDP to which the previously filed method is applied.

Accordingly, the plasma display panel of the present invention has the following advantages: (1) the panel is suitable for high resolution displays since it has no auxiliary discharge cell; (2) since scanning and sustaining are separated, the material of the writing electrode can be widely selected, to include ITO which has a good transmittivity; (3) low resistance material can be used for the sustaining electrode to enhance the operating margin and to allow for good memory operation; and (4) the panel is simplified in its structure and manufacturing method.

As described, the plasma display panel having the above advantages is applicable for high resolution televisions as well as functioning as a small display panel.

What is claimed is:

1. A plasma display panel comprising:

front and backing plates;

a plurality of barriers spaced from one another and arranged in a striped form on said front plate;

a sustaining electrode entirely covering a surface of said backing plate;

a plurality of first insulating layers disposed on said sustaining electrode in a matrix form;

a plurality of first electrodes disposed on said first insulating layers in a striped form, parallel to said plurality of barriers, and contacting said first insulating layers;

a plurality of second insulating layers spaced apart at a certain interval and disposed on said first electrodes in a striped form, perpendicular to said plurality of barriers; and a plurality of second electrodes disposed on and contacting said second insulating layers.

2. A method of driving a plasma display panel comprising front and backing plates, a plurality of barriers spaced with one another and arranged in a striped form on said front plate, a sustaining electrode entirely covering a surface of said backing plate, a plurality of first insulating layers disposed on said sustaining electrode in a matrix form, a plurality of first electrodes disposed on said first insulating layers in a striped form parallel to said plurality of barriers and contacting said first insulating layers, a plurality of second insulating layers spaced apart at a certain interval and disposed on said first electrodes in a striped form and perpendicular to said plurality of barriers, and a plurality of second electrodes disposed on and contacting said second insulating layers including:

applying a pulse train including pulses with a predetermined period to said sustaining electrode, each pulse having an amplitude equal to a second voltage subtracted from a first voltage, said pulse train being superimposed on the second voltage;

applying a first pulse having an amplitude equal to a fourth voltage subtracted from a third voltage to said first electrodes when the pulses of the pulse train have an amplitude equal to the second voltage, the first pulse being superimposed on the fourth voltage;

applying sequential pulses having an amplitude equal to a sixth voltage subtracted from a fifth voltage to said second electrodes when the pulses of the pulse train have an amplitude equal to the second voltage;

creating a discharge using a voltage equal to the sixth voltage subtracted from the third voltage and greater than a discharge firing voltage; and maintaining a discharge using a voltage equal to the fifth voltage subtracted from the first voltage and greater than a minimum discharge sustaining voltage but smaller than the discharge firing voltage.

3. The method for driving a plasma display panel as claimed in claim 2 wherein the first voltage is a discharge sustaining voltage.

4. The method for driving a plasma display panel as claimed in claim 2 wherein the second voltage is a discharge sustaining bias voltage.

5. The method for driving a plasma display panel as claimed in claim 2 wherein the third voltage is an anode voltage.

6. The method for driving a plasma display panel as claimed in claim 2 wherein the fourth voltage is an anode bias voltage.

7. The method for driving a plasma display panel as claimed in claim 2 wherein the fifth voltage is a cathode bias voltage.

8. The method for driving a plasma display panel as claimed in claim 2 wherein the sixth voltage is a cathode voltage.

9. A plasma display panel comprising:

front and backing plates;

a sustaining electrode entirely covering a surface of said backing plate;

a plurality of first insulating layers disposed on said sustaining electrode;

a plurality of barriers spaced from one another and arranged in a striped form on said sustaining electrode;

a plurality of first electrodes respectively disposed on said plurality of first insulating layers in a striped form alternating with and parallel to said barriers;

a plurality of second electrodes arranged in a striped form perpendicular to said plurality of first electrodes; and a plurality of second insulating layers disposed between overlapping portions of said plurality of first electrodes and said plurality of second electrodes.

10. A method of driving a plasma display panel comprising front and backing plates, a sustaining electrode formed over the entire surface of said backing plate, a plurality of first insulating layers disposed on said sustaining electrode, a plurality of barriers spaced with one another and arranged in a striped form on said sustaining electrode, a plurality of first electrodes disposed on said plurality of first insulating layers in a striped form alternating with and parallel to said barriers, a plurality of second electrodes arranged in a striped form perpendicular to said plurality of first electrodes, and a plurality of second insulating layers disposed between the overlapping portions of said plurality of first electrodes and said plurality of second electrodes including:

applying a pulse train including pulses with a predetermined period to said sustaining electrode, each pulse having an amplitude equivalent to a second voltage subtracted from a first voltage, the pulse train being superimposed on the second voltage;

applying a first pulse having an amplitude equal to a fourth voltage subtracted from a third voltage to said first electrodes when the pulses of the pulse train have an amplitude equal to the second voltage, the first pulse being superimposed on the fourth voltage;

applying sequential pulses having an amplitude equal to a sixth voltage subtracted from a fifth voltage to said second electrodes when the pulses of the pulse train have an amplitude equal to the second voltage;

creating a discharge using a voltage equal to the sixth voltage subtracted from the third voltage and greater than a discharge firing voltage; and maintaining a discharge using a voltage equal to the fifth voltage subtracted from the first voltage and greater than a minimum discharge sustaining voltage but smaller than the discharge firing voltage.

11. The method for driving a plasma display panel as claimed in claim 10 wherein the first voltage is a discharge sustaining voltage.

12. The method for driving a plasma display panel as claimed in claim 10 wherein the second voltage is a discharge-sustaining bias voltage.

13. The method for driving a plasma display panel as claimed in claim 10 wherein the third voltage is an anode voltage.

14. The method for driving a plasma display panel as claimed in claim 10 wherein the fourth voltage is an anode bias voltage.

15. The method for driving a plasma display panel as claimed in claim 10 wherein the fifth voltage is a cathode bias voltage.

16. The method for driving a plasma display panel as claimed in claim 10 wherein the sixth voltage is a cathode voltage.

17. A plasma display panel comprising:

front and backing plates;

a sustaining electrode entirely covering a surface of said front plate;

a plurality of barriers spaced from one another and arranged in a striped form on said sustaining electrode;

a plurality of first electrodes disposed on said backing plate in a striped form, parallel to said plurality of barriers;

a plurality of first insulating layers spaced apart at an interval and disposed on said first electrodes in a striped form, perpendicular to said plurality of barriers; and a plurality of second electrodes disposed on and in contact with said first insulating layers.

18. The plasma display panel as recited in claim 17 wherein the sustaining electrode is a transparent conductive material.

* * * * *